US005487463A

United States Patent [19]

Harris

[11] Patent Number: 5,487,463

[45] Date of Patent: Jan. 30, 1996

[54] BANDED BOTTLE NECK CARRIER

[75] Inventor: Randall L. Harris, Powder Springs, Ga.

[73] Assignee: Riverwood International Corporation, Atlanta, Ga.

[21] Appl. No.: 276,007

[22] Filed: Jul. 15, 1994

[51] Int. Cl.[6] ..... B65D 75/00

[52] U.S. Cl. ..... 206/145; 206/147; 206/148; 206/150; 206/151; 206/158; 206/161; 206/427

[58] Field of Search ..... 206/158, 161, 206/151, 150, 149, 148, 147, 145, 427

[56] References Cited

U.S. PATENT DOCUMENTS

| | | | |
|---|---|---|---|
| 2,654,474 | 10/1953 | Ringler | 206/158 |
| 2,680,556 | 6/1954 | Currie | 206/427 |
| 2,705,556 | 4/1955 | Ringler | 206/427 |
| 3,175,684 | 3/1965 | Andre et al. | 206/155 |
| 3,410,596 | 11/1968 | Slevin, Jr. | 206/158 |
| 3,653,504 | 4/1972 | Saumsiegle | 206/161 |
| 3,807,624 | 4/1974 | Funkhouser | 206/427 |
| 4,339,032 | 7/1982 | Wood | 206/158 |
| 4,378,879 | 4/1983 | Killy | 206/158 |
| 4,403,689 | 9/1983 | Wood | 206/427 |
| 5,323,895 | 6/1994 | Sutherland et al. | 206/147 |

FOREIGN PATENT DOCUMENTS

| | | | |
|---|---|---|---|
| 753970 | 3/1967 | Canada | 206/158 |

*Primary Examiner*—Paul T. Sewell
*Assistant Examiner*—Marie Denise Patterson

[57] ABSTRACT

A bottle neck carrier and a spaced band encircling the bottles. The band snugly holds the bottles in place while they are supported by the carrier and at the same time covers the pricing code on the bottles. The support panel of the carrier may be separate from the band or attached to it. The support panel may be formed from two layers of material, and in the embodiment where the support panel is attached to the band, each layer is connected to the band along fold lines. Side panels connect the support panel layers to the band in the latter arrangement.

9 Claims, 4 Drawing Sheets

BANDED BOTTLE NECK CARRIER

FIELD OF THE INVENTION

This invention relates to bottle carriers of the type that employ foldable support tabs to engage the underside of bottle flanges. More particularly, it relates to carriers of this type which include structure for blocking the pricing code on the bottles.

BACKGROUND OF THE INVENTION

Certain types of articles, such as food or beverage containers, are commonly sold either as individual units or in a multi-container carton. Each article is normally marked with a pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carrier. An enclosed carrier is quite expensive, however, due to the greater amount of stock required. Moreover, when packaging large plastic bottles whose bottoms are of petaloid design, difficulties are encountered in aligning the spaced petaloid feet with the bottle cutouts conventionally provided in the lower portion of the side panels. This is especially troublesome when the same packaging line is used for bottles having different numbers of petaloid support feet, since provision must be made to align the feet with the cutouts.

Another way to cover the pricing code on individual articles is to package them in wrap-around carriers having partial end panels of a size sufficient to cover the pricing code on the end articles in the package. Although such a design requires less stock than a fully enclosed carrier and is more economical to produce, the cost is still too great for certain markets.

A more economical carrier for beverage bottles is a bottle neck carrier that employs so-called starburst support tabs surrounding the bottle neck openings in a carrier support panel. These tabs support the bottles by contacting the underside of the flange or shoulder that projects out from the bottle neck. Such carriers, however, do not lend themselves to the provision of partial side and end panels to cover pricing codes. In addition, if individual bottles rotate or swing from their neck supports while the package is being carried, the user often perceives them to be swinging out of control, suggesting less than adequate support.

It is an object of the invention to provide a bottle neck carrier which covers the pricing code of the bottles. Another object is to provide a carrier of this type which snugly holds the bottles in place to prevent them from moving.

BRIEF SUMMARY OF THE INVENTION

The invention is incorporated in a bottle neck carrier which includes support tabs extending up from the periphery of bottle openings in a support panel. The support tabs engage the underside of an outwardly projecting shoulder on the bottles to support the bottles in conventional fashion. In addition, the carrier includes a flexible band spaced from the support panel which snugly encircles the bottles, holding them in place while the package is being carried and blocking the pricing code on the outer bottles.

The support panel may be comprised of a plurality of layers to strengthen the carrier. In one arrangement the double-layered support panel is separate from the flexible band. In another, it is connected to the band by side panels. In either case both layers contain aligned bottle openings. Preferably, the flexible band includes opposite end panel sections, opposite side panel sections and transverse fold lines in corner areas of the package which separate the end and side panel sections to allow the band to more closely follow the adjacent curved surface of the corner bottles.

The carrier is inexpensive to produce and simple to apply to the bottles when forming a package. The features which enable the carrier to function in this manner are brought out in more detail in connection with the description of the preferred embodiments, wherein the above and other aspects of the invention, as well as other benefits, will readily become apparent.

DETAILED DESCRIPTION OF THE PREFERRED EMBODIMENTS

Figure 1:
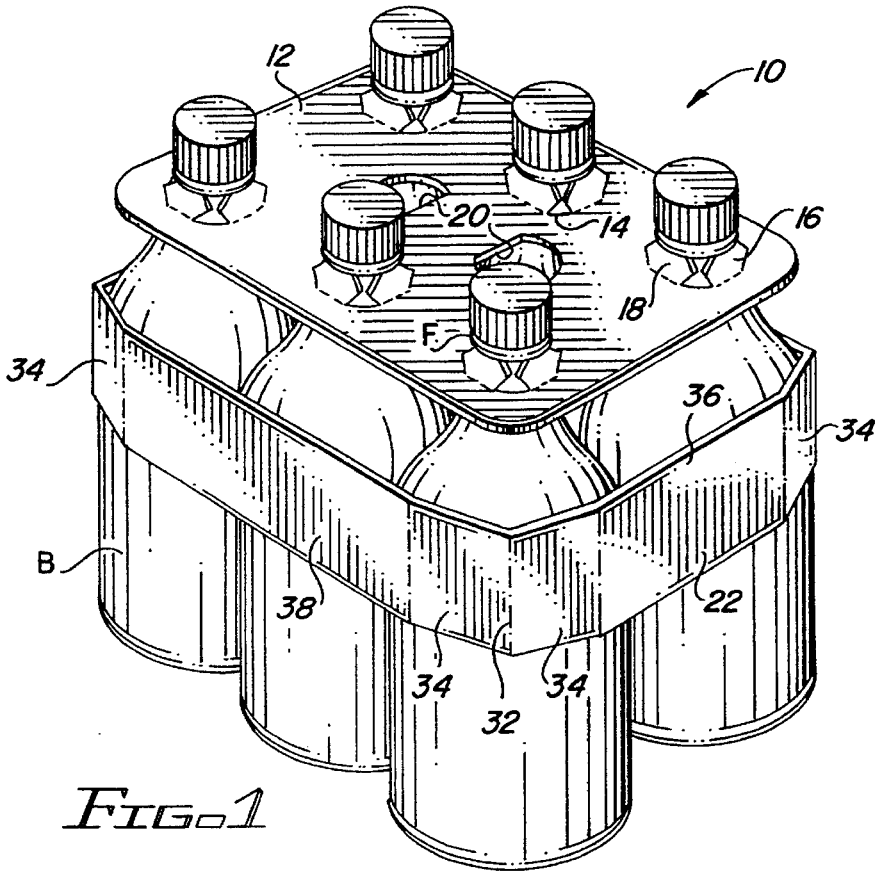
FIG. 1 is a pictorial view of one embodiment of the carrier of the invention.

Referring to FIG. 1, a package 10 is comprised of two rows of three bottles B and a carrier support panel 12 for lifting and carrying the bottles. Included in the support panel are openings 14 through which the necks of the bottles extend. The end edges of tabs 16, which are connected to the panel 12 by fold lines 18 extending about the periphery of the bottle neck openings 14, contact the underside of the flanges F on the bottles to support the bottles when the carrier is lifted. Finger holes 20 in the support panel enable the carrier to be readily lifted. In addition, a band 22 encircles the bottles at a location beneath the support panel which allows the band to cover the pricing code on the bottles. Because the band tightly fits about the bottles to firmly contain them, they are prevented from individually rotating or swinging from the support panel when the package is carried. By tightly holding the bottles together, the band also permits the packages of bottles to be stacked on a pallet for shipping and handling.

Figure 2A:
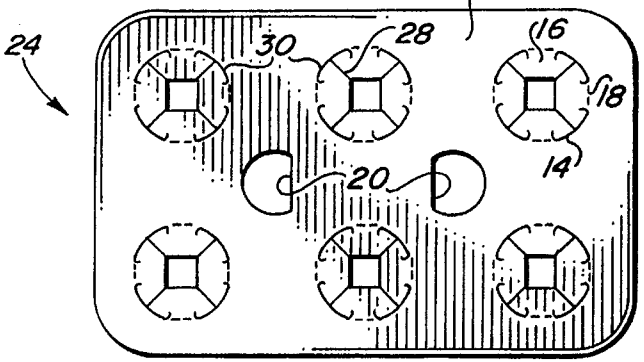
FIG. 2A is a plan view of a blank for forming the support panel of the carrier of FIG. 1.
Figure 2B:
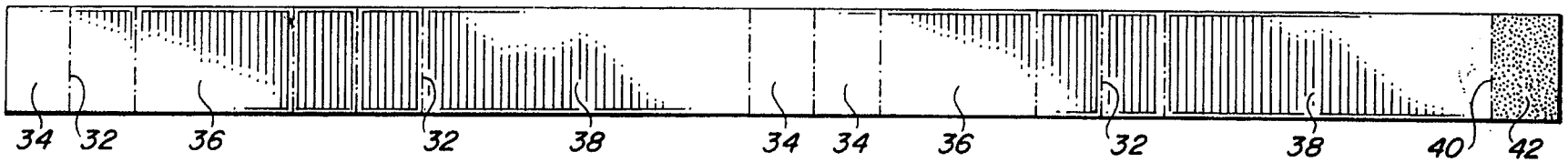
FIG. 2B is a plan view of a blank for forming the band used in conjunction with the support panel of FIG. 2A.

A blank 24 for forming the support panel is shown in FIG. 2A and a blank 26 for forming the band is shown in FIG. 2B. The blanks are preferably formed of paperboard, but may be of any suitable material having sufficient strength and flexibility to function in the manner of paperboard. The support panel blank 24 is identical to the support panel shown in FIG. 1, requiring no folding or other fabrication steps. As is conventional, the diameter of the bottle openings 14 in the support panel is related to the diameter of the neck portion of the bottles to be packaged so that the shoulder or flange of the bottle neck is able to pass through the opening while contacting the support tabs 16 to pivot them up about their fold lines. The support tabs 16 comprise four contiguous tabs arranged so that the fold lines 18 of adjacent tabs are at right angles to each other. Slits 28, extending at 45° to the adjacent tab fold lines, separate the tabs and arcuate slits 30 separate the tab fold lines.

The blank 26 of FIG. 2B is an elongated rectangular strip which includes transverse fold lines 32 arranged in groups of three. The areas or segments 34 between the fold lines of each group are corner panel sections, the relatively short areas or segments 36 between the fold line groups are end panel sections and the relatively long areas 38 between the fold line groups are side panel sections. A single fold line 40 spaced from one end of the blank forms a glue flap 42.

To form the package of FIG. 1, the bottles to be packaged are grouped together and a band 22 is moved down over the bottles. The band will have been formed by gluing the glue flap 42 to the end corner panel section 34, which makes the fold line 40 the end fold line of the group of fold lines shown at the left of the blank in FIG. 2B. As the band 22 is applied, its circumference is such that the band folds slightly about the fold lines 32, creating the corner panels 34. This allows the corner areas to more closely follow the contour of the corner bottles. The blank 24, after being properly aligned, is then pushed down over the tops of the bottles. The upper portions of the bottles move through the openings 14 in the support panel, pivoting the support tabs 16 up until they snap into place as the edges of the tabs engage the underside of the bottle flanges F.

Figure 3:
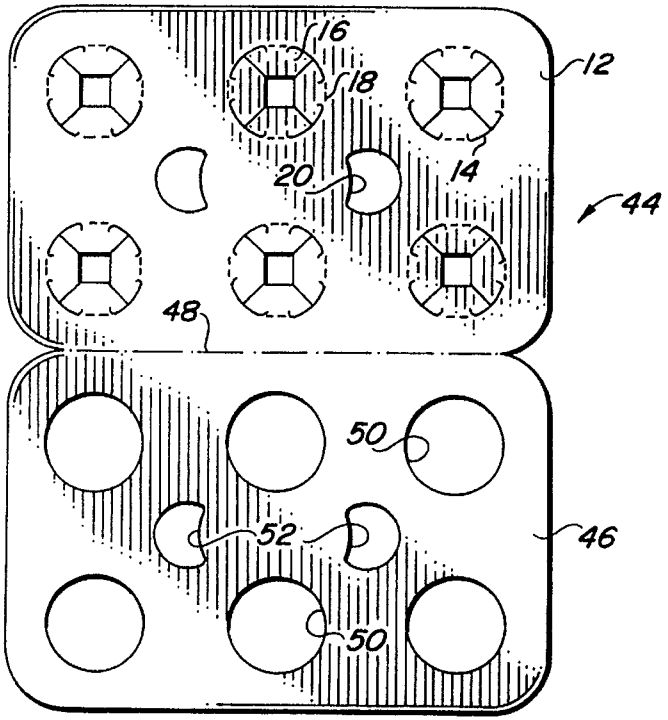
FIG. 3 is a plan view of a modified blank for forming a reinforced support panel.
Figure 4:
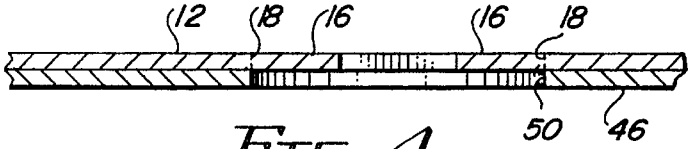
FIG. 4 is an enlarged partial sectional view through aligned bottle openings in a reinforced support panel.

The support panel can be further strengthened by adding an additional layer of panel material. As shown in FIG. 3, this can be accomplished by providing a blank 44 comprised of a panel section 12 identical to the panel of FIG. 1 and a panel section 46 connected to the panel section 12 by fold line 48. The panel section 46 includes bottle openings 50 which are aligned with the bottle openings 14 when the panel sections are folded against each other. Similarly, finger holes 52 in the panel section 46 are aligned with the finger holes 20. Except for having a double thick support panel, a carrier formed from the blank 44 is similar to the carrier of FIG. 1. Instead of utilizing the blank 44, a double thick support panel may be provided by laminating a panel similar to the panel section 46 to the panel 12 of the blank 24 of FIG. 2A. In either case a section through aligned bottle openings would appear as in FIG. 4.

Figure 5:
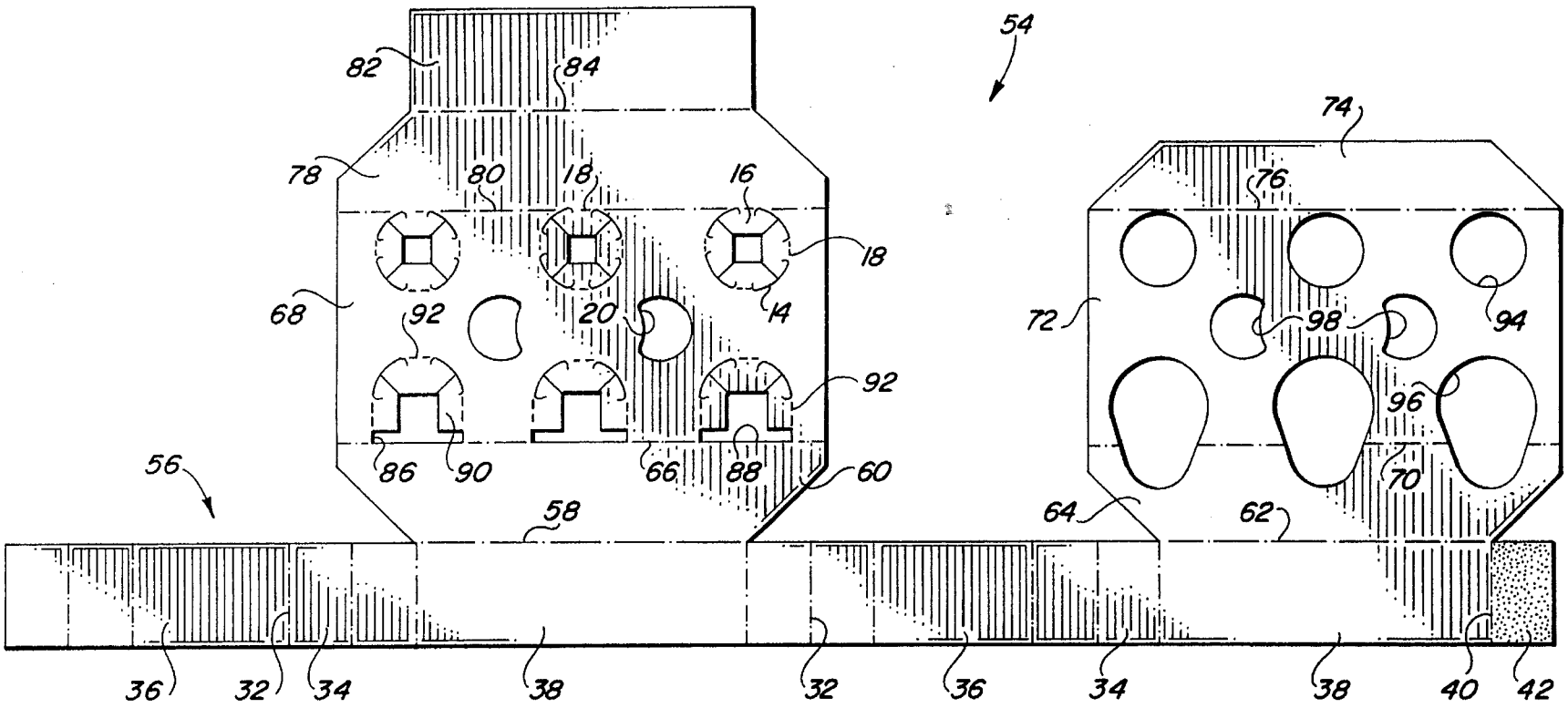
FIG. 5 is a plan view of a blank for forming another embodiment of the carrier of the invention.

A package incorporating a double thick support panel may also be formed from the single blank 54 shown in FIG. 5. The blank includes a band section 56 which is identical to the band blank 26 of FIG. 2B, having fold lines 32 forming side panel areas 38, end panel areas 36 and corner panel areas 34. Connected to one of the side panel areas 38 along fold line 58 is side panel section 60, and connected to the other side panel area 38 along fold line 62 is side panel section 64. The side panel section 60 is connected along fold line 66 to outer support panel section 68, while the side panel section 64 is connected along fold line 70 to inner support panel section 72. The inner support panel section 72 is also connected to an opposite side panel section 74 by fold line 76. Similarly, the outer support panel section 68 is connected to side panel section 78 by fold line 80. In addition, a glue flap 82 is connected to the side panel section 78 along fold line 84.

The outer support panel section 68 includes a row of bottle openings 14 which are similar to the openings 14 in the carrier of FIG. 1, with the fold line 80 coinciding with the fold lines 18 of the adjacent support tabs 16. The bottle openings 86 in the opposite row are larger than the openings 14 and are not generally circular as are the openings 14. Instead, they include straight sides which terminate at edges 88 which are aligned with, and interrupt, the fold line 66. Tabs 90, which are connected along fold lines 92 along the other three sides of the bottle openings, are larger than the tabs 16 in order to extend in far enough to contact the underside of the bottle flanges. As in the first embodiment, the outer support panel section includes finger holes 20.

The inner support panel section 72 includes bottle openings 94 adjacent the fold line 76 which are substantially the same size as the openings 14 in the outer support panel section. The openings 96 adjacent the fold line 70 are considerably larger, and in addition extend across the fold line 70 into the side panel section 64. Finger holes 98, which preferably are somewhat larger than the finger holes 20, are also provided.

Figure 6:
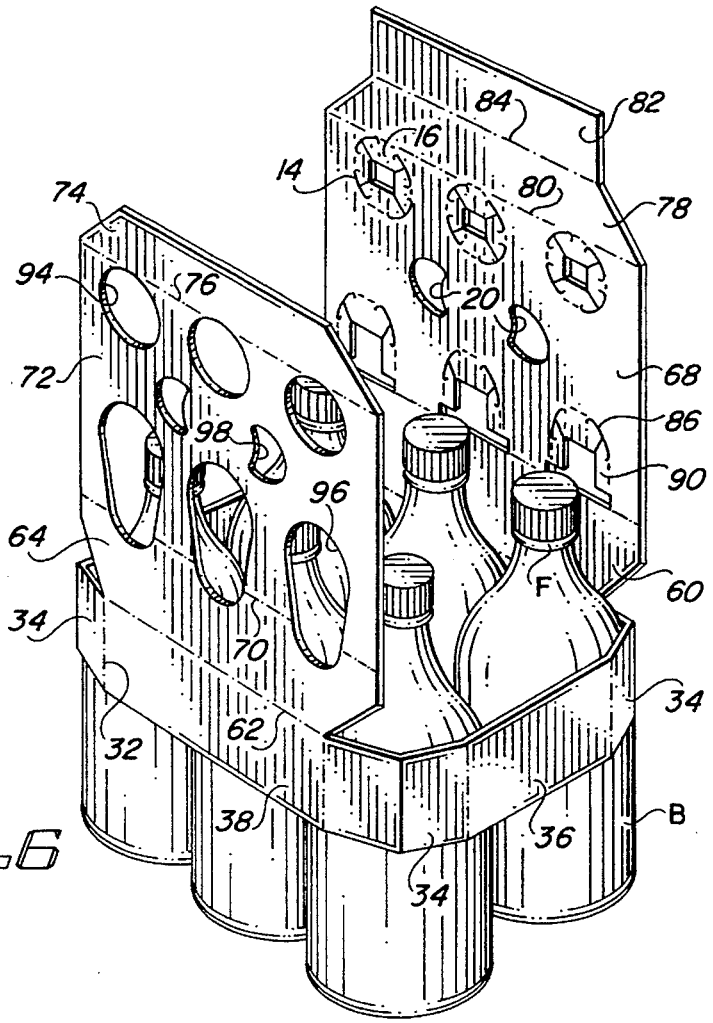
FIG. 6 is a pictorial view of the carrier blank of FIG. 5 in an initial stage of carrier formation.

To form a carrier from the blank 54, the glue flap 42 of the band section 56 is adhered to the opposite end corner panel section 34 to form a continuous band. The band is then moved down over a group of bottles to be packaged, resulting in the inner and outer support panel sections being located on opposite sides of the group of bottles. This initial phase of carrier formation is illustrated in FIG. 6.

The next step is to pivot the inner support panel section 72 in about the fold line 62 to bring the bottle openings 96 and 94 down over the tops of the bottles. Because the bottle openings 96 move through a relatively short arc, they approach the bottle tops at an angle to the vertical. The large size of the openings compensates for this path and allows them to move over the tops and flanges of the adjacent bottles. The smaller openings 94, which move through a longer arc and approach the bottles on a more nearly vertical path, are able to clear the bottle tops and move down over the bottle flanges.

Figure 8:
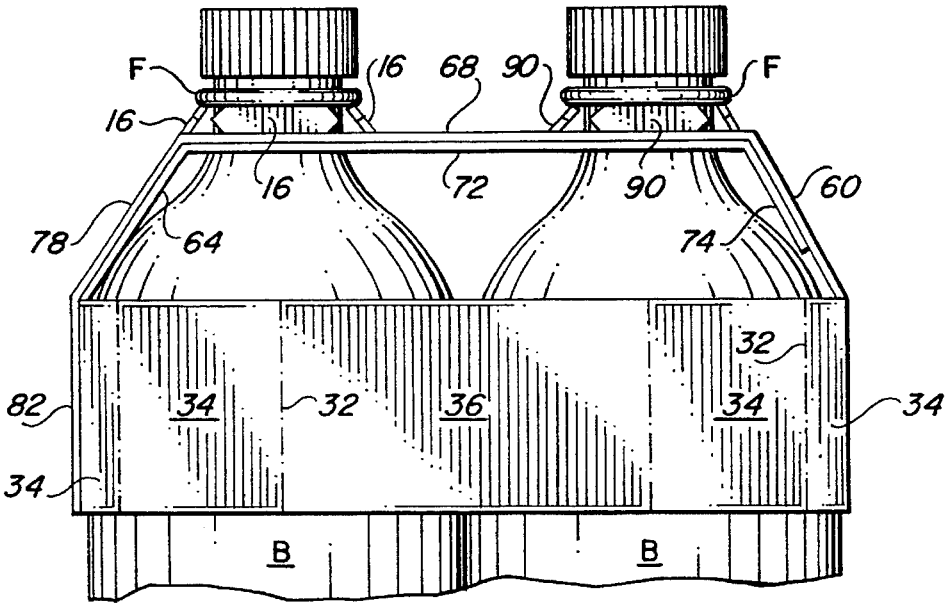
FIG. 8 is an enlarged partial end view of the carrier of FIG. 7.
Figure 7:
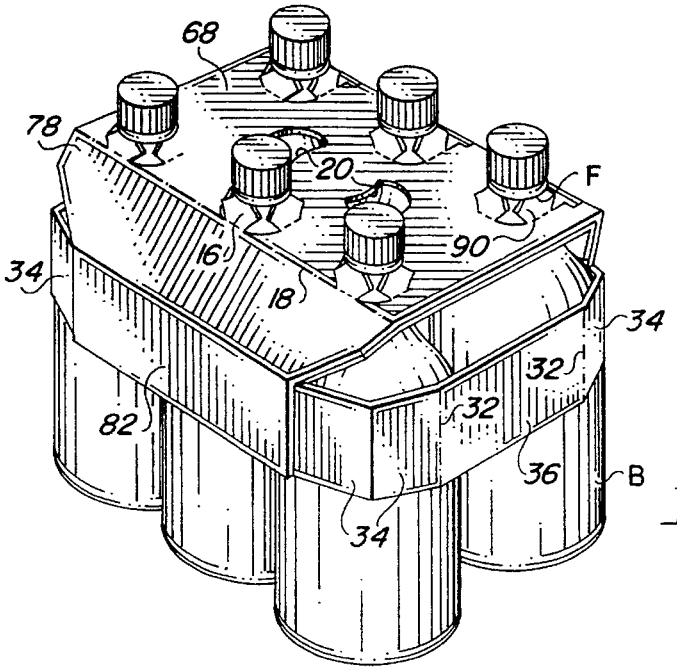
FIG. 7 is a pictorial view of a carrier formed from the blank of FIG. 5.

The outer support panel section 68 is then pivoted about the fold line 58 to bring the bottle openings 86 and 14 down over the tops of the bottles. As in the inner panel support section, the size of the large openings 86 allows the openings to move over the tops and flanges of the adjacent bottles, while the smaller openings, due to their more vertical path, are able to also move down over the bottle flanges. The finger holes 20 of the outer support panel section 68 are aligned with the finger holes 98 of the inner support panel section 72. The carrier is then pulled down so as to be tightly held against the bottles and the glue flap 82 is folded down about the fold line 84 and glued to the adjacent side panel section 38 of the band. The final configuration of the carrier is illustrated in FIGS. 7 and 8, which show the side panels 64 and 74 of the inner support panel and the side panels 60 and 78 of the outer support panel to substantially follow the upper sloped configuration of the bottles. Preferably, the inner side panel 74 is shorter than the side panel 60 and terminates above the band so as not to interfere with the snug contact of the band and the bottles. It is not necessary to glue the inner and outer support panels to each other since the tight fit of the panels and the fact that a user's fingers lift the carrier from the underside of the inner support panel. As in the first embodiment, the corner panels 34 of the band substantially follow the contour of the corner bottles, and the band acts to tightly hold the bottles against sideward movement.

In order not to interfere with movement of the bottle openings 86 over the tops of adjacent bottles, no support tab has been provided adjacent the fold line 66 of the outer panel section 68. The tabs 90 extending transversely from the fold line 66 terminate short of the openings for the same reason. The three support tabs 90, being quite long compared to the tabs 16, provide adequate support for the bottles extending through the openings 86.

Although the bottles have been shown as having a separate integral flange, the terms "flange" or "shoulder" as used in the specification and claims are intended to include the underside of bottle caps in bottles which do not incorporate an integral flange.

It can now be appreciated that the invention provides a unique support carrier which incorporates certain desirable features of a wrap-around carrier and a bottle neck clip. The tightly wrapped band provides a number of functions, including holding the bottles in place, allowing the packages to be stacked, providing space for graphics and covering the pricing code on the bottles. The features enabling the carrier to function in this way are incorporated into the carrier without requiring expensive carrier blanks or complicated maneuvers by packaging machines. It will be understood that the invention is not limited to all the specific details described in connection with the preferred embodiments, except as they may be within the scope of the appended claims. Changes to certain features of the preferred embodiment which do not alter the overall basic function and concept of the invention are therefore contemplated.

What is claimed is:

1. A carrier package for a plurality of rows of bottles having a neck portion which includes an outwardly projecting shoulder, comprising:

a continuous flexible band snugly encircling the bottles;

the band having an upper edge and a lower edge, the lower edge being a free unconnected edge;

opposite side panels connected to the upper edge of the band;

one of the side panels being connected to an outer support panel ply and the other side panel being connected to an inner support panel ply, the outer and inner support panel plies being in face-to-face relationship to form a two-ply support panel;

each support panel ply containing bottle openings which are aligned in the support panel and through which the necks of the bottles extend; and a plurality of support tabs connected to the outer support panel ply by fold lines extending along portions of the periphery of each bottle opening therein, the support tabs having edges engaging the underside of the bottle shoulders.

2. A carrier package as defined in claim 1, wherein the outer support panel ply is connected to an outer side panel section and the inner support panel ply is connected to an inner side panel section, the inner side panel section contacting said one side panel in face-to-face relationship and the outer side panel section contacting said other side panel in face-to-face relationship.

3. A carrier package as defined in claim 2, wherein the outer side panel section is connected to a glue flap, the glue flap being adhered to the flexible band.

4. A carrier package as defined in claim 1, wherein the flexible band includes opposite end panel sections, opposite side panel sections and fold lines extending transversely of the width of the band, the transverse fold lines separating the end and side panel sections in corner areas of the package, the transverse fold lines in a corner area being comprised of a plurality of spaced substantially parallel fold lines.

5. A carrier package as defined in claim 1, wherein the inner and outer support panel plies include bottle openings arranged in two rows, one of the rows in each ply being nearer the side panel connected to that ply than the other row in said ply, the bottle openings in said nearer rows being larger than the bottle openings in the other rows.

6. A blank for forming a carrier for supporting bottles having a neck portion which includes an outwardly projecting shoulder, comprising:

an elongated flexible strip capable of being formed into a continuous band, the strip having an upper edge and a lower unconnected edge, a first side panel section connected to the upper edge of the flexible strip;

an outer support panel section connected to the first side panel section, the outer support panel section containing openings for receiving the necks of the bottles;

a plurality of support tabs connected to the outer support panel section by fold lines extending along portions of the periphery of each bottle opening, the support tabs having edges for engaging the underside of the shoulders of bottles in a carrier formed from the blank;

a second side panel section connected to the upper edge of the flexible strip at a location spaced from the first side panel section; and an inner support panel section connected to the second side panel section, the inner support panel section containing openings for receiving the necks of the bottles.

7. A blank as defined in claim 6, wherein the outer support panel section is connected to an outer side panel section and the inner support panel section is connected to an inner side panel section, the inner side panel section contacting the first side panel section in face-to-face relationship in a carrier formed from the blank and the outer side panel section contacting the second side panel section in face-to-face relationship in a carrier formed from the blank.

8. A blank as defined in claim 7, wherein the outer side panel section is connected to a glue flap.

9. A blank as defined in claim 6, wherein the flexible band includes end panel sections, side panel sections and fold lines extending transversely of the width of the band, the transverse fold lines separating the end and side panel sections defining corner areas, the transverse fold lines in a corner area being comprised of a plurality of spaced substantially parallel fold lines.

* * * * *